US008375671B1

(12) United States Patent
Thrasher et al.

(10) Patent No.: US 8,375,671 B1
(45) Date of Patent: Feb. 19, 2013

(54) SYSTEM AND METHOD FOR PROVIDING BASEMENT WALL STABILIZATION

(75) Inventors: Daniel J. Thrasher, Omaha, NE (US); Aaron W. Ruskamp, Waverly, NE (US)

(73) Assignee: Thrasher Basement Systems, Inc., Omaha, NE (US)

( * ) Notice: Subject to any disclaimer, the term of this patent is extended or adjusted under 35 U.S.C. 154(b) by 20 days.

(21) Appl. No.: 13/208,994

(22) Filed: Aug. 12, 2011

(51) Int. Cl.
*E02D 37/00* (2006.01)
*E04G 23/00* (2006.01)

(52) U.S. Cl. ..... 52/514; 52/293.2; 52/351; 52/741.13; 405/262

(58) Field of Classification Search ..... 52/514, 52/293.2, 741.41, 745.09, 741.13, 291, 244, 52/351; 405/262, 286, 287, 150.2, 302
See application file for complete search history.

(56) References Cited

U.S. PATENT DOCUMENTS 4,189,891 A * 2/1980 Johnson et al. ..... 52/741.13
4,952,097 A * 8/1990 Kulchin ..... 405/262
5,588,784 A * 12/1996 Brandl et al. ..... 405/262
6,565,288 B1 * 5/2003 McCallion ..... 405/259.5
6,769,222 B2 * 8/2004 Billante ..... 52/741.15
2003/0192280 A1 * 10/2003 Billante ..... 52/514
2004/0163341 A1 * 8/2004 Gregory et al. ..... 52/294
2004/0179901 A1 * 9/2004 Kulchin ..... 405/262

* cited by examiner

*Primary Examiner* — Brian Glessner
*Assistant Examiner* — Brian D Mattei
(74) *Attorney, Agent, or Firm* — Merchant & Gould P.C.

(57) ABSTRACT

A system for stabilizing an existing basement wall includes a wall stabilizing system including a first wall anchoring device installed on a surface of the existing basement wall. The first wall anchoring device may further include a first anchoring plate fastened to a surface of the existing basement wall tethered via a substantially rigid rod to a second anchoring plate embedded underground outside the existing basement wall at a distance away from the existing basement wall. The system may include a first layer of sprayable concrete material applied over the existing basement wall. System may further include a third anchoring plate installed on a surface of the first layer of sprayable concrete material. The system may also include a second layer of sprayable concrete material applied over the first layer of sprayable concrete material.

20 Claims, 10 Drawing Sheets

SYSTEM AND METHOD FOR PROVIDING BASEMENT WALL STABILIZATION

FIELD OF THE INVENTION

The present invention relates generally to systems for stabilizing basement or foundation walls.

BACKGROUND OF THE INVENTION

Basement and foundation walls are designed to provide a solid base for the structures above them. When basement and foundation walls begin to crack, bow, or tip inward, they can no longer provide adequate support for a structure. Basement and retaining walls are designed to resist the lateral earth pressures that are exerted against them, but factors such as hydrostatic pressure, frost and expansive clays can overstress the walls and cause them to crack or even collapse.

SUMMARY OF THE INVENTION

Accordingly, the present invention is directed toward a system and method for stabilizing an existing basement or foundation wall.

In one embodiment, a system for stabilizing an existing basement wall includes: a wall stabilizing system including a first wall anchoring device installed on a surface of the existing basement wall. The first wall anchoring device may further include a first anchoring plate fastened to a surface of the existing basement wall tethered via a substantially rigid rod to a second anchoring plate embedded underground outside the existing basement wall at a distance away from the existing basement wall. The system may include a first layer of sprayable concrete material applied over the existing basement wall. System may further include a third anchoring plate installed on a surface of the first layer of sprayable concrete material. The wall anchoring device may include a fastener for fastening the third anchoring plate to the first anchoring plate through the first layer of sprayable concrete material and one or more fasteners for fastening the third anchoring plate to a surface of the first layer of sprayable concrete material. The system may also include a second layer of sprayable concrete material applied over the first layer of sprayable concrete material.

In another embodiment, a method for stabilizing an existing basement wall includes: installing a first wall anchoring device on the existing basement wall further including fastening a first anchoring plate to the existing basement wall and tethering the first anchoring plate via a substantially rigid rod to a second anchoring plate embedded underground outside the existing basement wall at a distance away from the existing basement wall. The first anchoring plate may provide a first amount of support to the existing basement wall. Method may include applying a first layer of sprayable concrete material over the existing basement wall, the first layer of sprayable concrete material substantially covering the first anchoring plate device. Method may also include allowing the first layer of sprayable concrete material to substantially or completely cure. Method may also include installing a third anchoring plate on the first layer of sprayable concrete material, further including fastening a third anchoring plate via a fastener to the first anchoring plate through the first layer of sprayable concrete material. Method may also include applying a second layer of sprayable concrete material over the first layer of sprayable concrete material, the second layer of sprayable concrete material substantially covering the third anchoring plate.

It is to be understood that both the foregoing general description and the following detailed description are exemplary and explanatory only and are not restrictive of the disclosure. The accompanying drawings, which are incorporated in and constitute a part of the specification, illustrate one or more embodiments of the disclosure and together with the general description, serve to explain the principles of the disclosed embodiments.

BRIEF DESCRIPTION OF THE DRAWINGS

The numerous objects and advantages of the present invention may be better understood by those skilled in the art by reference to the accompanying figures in which.

The use of the same symbols in different drawings typically indicates similar or identical items.

DETAILED DESCRIPTION OF THE INVENTION

Reference will now be made in detail to the presently preferred embodiments of the invention, examples of which are illustrated in the accompanying drawings. With reference to the figures, FIGS. 1-5 depict implementations of an exemplary system described herein. One skilled in the art will recognize that the herein described components, devices, and objects and the discussion accompanying them are used as examples for the sake of conceptual clarity and that various configuration modifications are within the skill of those in the art. Consequently, as used herein, the specific exemplars set forth and the accompanying discussion are intended to be representative of their more general classes. In general, use of any specific exemplar herein is also intended to be representative of its class, and the non-inclusion of such specific components, devices, and objects herein should not be taken as indicating that limitation is desired.

Figure 1:
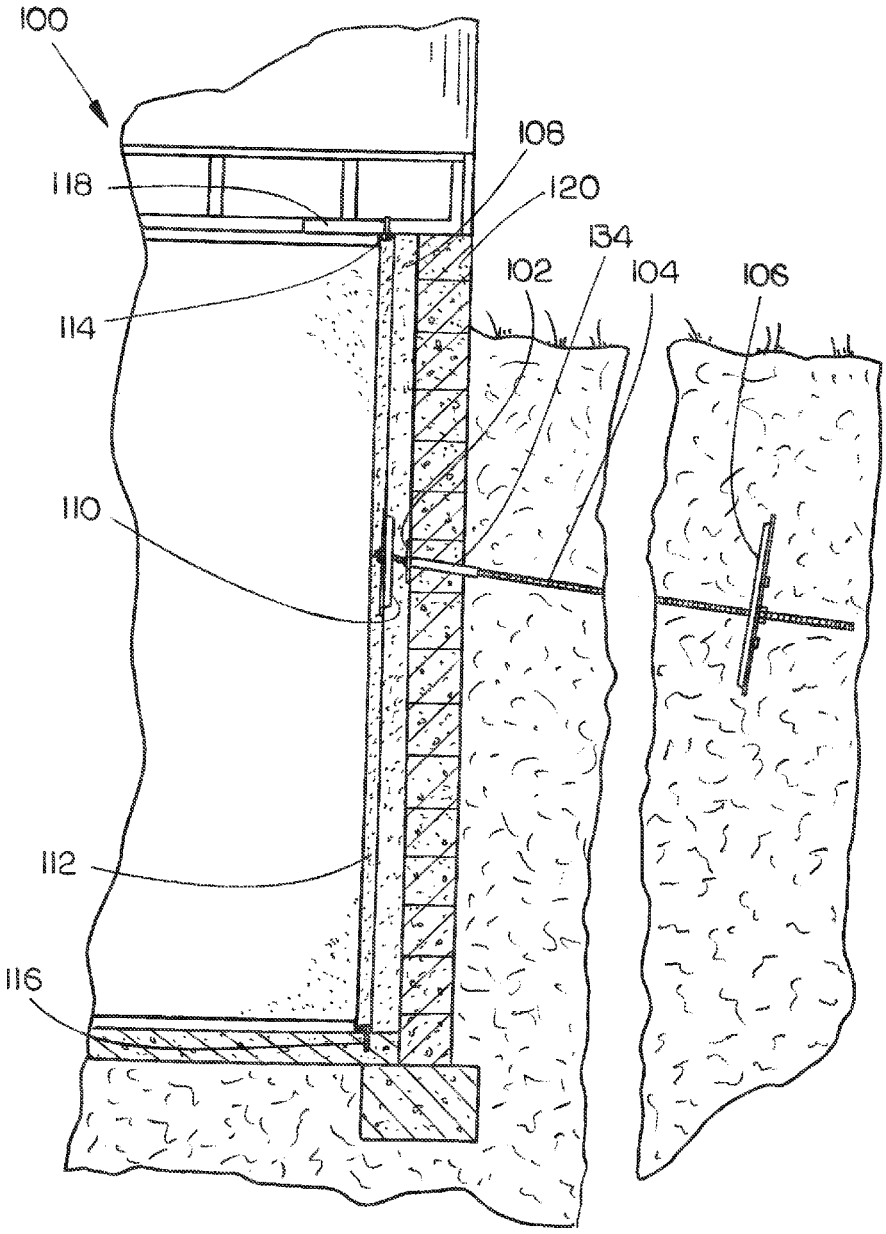
FIG. 1 is a cross-sectional view of a concealed wall stabilizing system according to an embodiment of the disclosure.

Referring generally to FIGS. 1-5, a system 100 for stabilizing an existing basement wall is shown. Referring to FIG. 1, a cross-sectional view of a wall stabilizing system 100 according to an embodiment of the disclosure is shown. The system 100 may include a wall stabilizing system including a first wall anchoring device installed on a surface of the existing basement wall 120. The first wall anchoring device may further include a first anchoring plate 102 fastened to a surface of the existing basement wall 120 and tethered via a substantially rigid rod 104 to a second anchoring plate 106 embedded underground outside the existing basement wall 120 at a distance away from the existing basement wall 120. The first anchoring plate 102 may be fastened to the rod 104 via a fastener 132 and may provide a first amount of support to the existing basement wall 120. Wall stabilizing system may be similar to a Geo-Lock Wall Anchor System™, provided by Foundation Supportworks, Inc. of Omaha, Nebr.

The system 100 may include a first layer of sprayable concrete material 108 applied over the existing basement wall 120. The first layer of sprayable concrete material 108 may substantially or completely cover the first anchoring plate 102 and the existing basement wall 120. The first layer of sprayable concrete material 108 may be between about 1 to 6 inches in thickness. The first layer of sprayable concrete material 108 may provide additional support and stabilization for the existing basement wall. The first layer of sprayable concrete material 108 may be substantially smoothed out by any smoothing technique. Alternatively, the first layer of sprayable concrete material 108 may be left unaltered after spraying.

It is contemplated that the sprayable concrete material may be shotcrete, or any type of concrete conveyable through a hose or other spraying device and projected (e.g., pneumatically projected) at any suitable velocity onto a surface. In some instances, sprayable concrete material may be a dry-type mix (e.g., gunite) or a wet-type mix. Any formulation of sprayable concrete material may be utilized. Sprayable concrete material may undergo placement and compaction simultaneously due to the force with which it is projected from the nozzle. Sprayable concrete material may be impacted onto any type or shape of surface, including vertical or overhead areas. Sprayable concrete material may be reinforced via any concrete reinforcement method. Concrete reinforcement may include, for example, steel reinforcement (e.g., rebar), fiber reinforcement (e.g., carbon fiber and/or synthetic fiber), mesh reinforcement (e.g., fiber mesh and/or wire mesh), etc.

System 100 may further include a third anchoring plate 110 installed on a surface of the first layer of sprayable concrete material 108. The wall anchoring device may include a fastening system 104, 134 for fastening the third anchoring plate 110 to the first anchoring plate 102 through the first layer of sprayable concrete material and one or more fasteners 128, 130 for fastening the third anchoring plate 110 to a surface of the first layer of sprayable concrete material 108. The first layer of sprayable concrete material 108 may be allowed to substantially or completely dry prior to installation of the third anchoring plate 110. The first anchoring plate 102 may have an area less than the area of the third anchoring plate 110.

The system 100 may also include a second layer of sprayable concrete material 112 applied over the first layer of sprayable concrete material 108. The second layer of sprayable concrete material 112 may substantially or completely cover the third anchoring plate 110 and the first layer of sprayable concrete material 108. The second layer of sprayable concrete material 112 may be between about 1 to 5 inches in thickness. The first layer of sprayable concrete material 108 may be substantially smoothed out by any smoothing technique. The second layer of sprayable concrete material 112 may provide further additional support and stabilization for the existing basement wall.

In one embodiment, the total thickness of the first layer of sprayable concrete material 108 and the second layer of sprayable concrete material 112 may be between about 5 to 10 inches. Greater or lesser thicknesses may be contemplated as necessary or desired. The existing basement wall may not be removed at any time before, during or after the application of either the first or second layers of sprayable concrete material. Rather, the existing basement wall remains in place and is provided additional support from the wall stabilizing system and layers of sprayable concrete material. It is further contemplated that any number of additional layers of sprayable concrete material of any thickness may be applied over the second layer.

In one embodiment, first and third anchoring plates 102, 110, may be approximately, two feet by one foot. Second anchoring plate may smaller, ranging from about 6 inches by 6 inches to 1 foot by one foot. It is contemplated, however, that anchoring plates may be any size and any combination of different sized anchoring plates may be utilized. First anchoring plate 102 may be fastened (e.g., bolted) to the existing basement wall by any fastening means (e.g., a rod and held in place by a bolt). A hole may be drilled through the existing basement wall, and a trench may be dug into the earth in a corresponding region outside existing basement wall. The rod may be inserted through the wall and the trench, and connected to the second anchoring plate 106 positioned in the ground. Second anchoring plate 106 may be disposed within the earth up to about 10 feet away from the wall.

Second anchoring plate may 106 be composed of a heavy-duty material (e.g., galvanized steel or other alloy) earth anchor embedded into the soil out away from the existing basement wall. Thus, second anchoring plate 106 may be, for example, a below ground driveable wall anchoring device. First anchoring plate 102 may likewise be composed of a heavy-duty material. Rod components may also be composed of a heavy-duty material. The first and second anchoring plates 102, 106 may assist in maintaining the stability of the existing basement wall (e.g., maintaining the foundation wall in its stabilized position). In alternative embodiments, wall anchoring device may include a plurality of helical anchoring devices imbedded in the earth outside the existing basement wall, wherein the one or more helical anchoring devices are mechanically screwed through the existing basement wall and through a small hole cored through the existing basement wall out into the soil. Upon satisfactory installation of the plurality of helical anchoring devices (e.g., once appropriate distances and capacities are reached) a wall plate (e.g., first anchoring plate 102) may then be fastened to the existing basement wall.

Figure 2A:
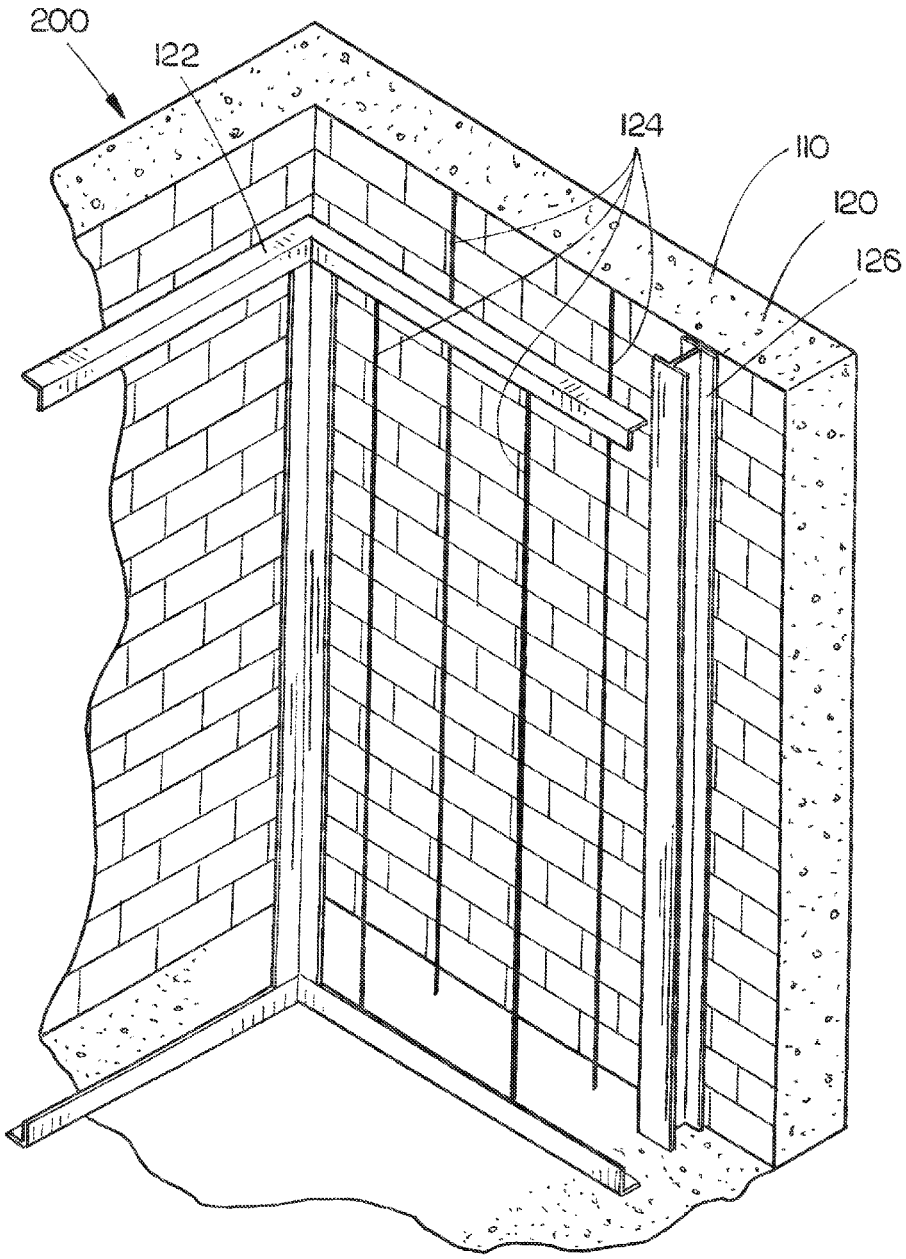
FIG. 2A is an exploded isometric view of an existing basement wall according to an embodiment of the disclosure.

Referring to FIG. 2A, an exploded isometric view 200 of an existing basement wall 120 including additional components of the system 100 for stabilizing an existing basement wall according to an embodiment of the disclosure is shown. The system 100 may also include a framing apparatus 122 installed substantially about the perimeter of the existing basement wall. Framing apparatus 122 may provide additional support for the first and second layers of sprayable concrete material. Framing apparatus 122 may be permanent (e.g., unremovable) or temporary (e.g., removable).

One or more additional floor joists 118 may be installed along the top edge of first layer of sprayable concrete material 108 and the second layer of sprayable concrete material 112 for additional support. One or more concrete anchors 116 may also be installed (e.g., drilled into a top or bottom edge of the first layer of sprayable concrete material 108 and/or the second layer of sprayable concrete material 112.

A plurality of vertically disposed guide wires 124 may be utilized when applying the first and second layers of sprayable concrete material 108, 112. FIG. 2A illustrates the alternative embodiment wherein vertically disposed guide wires 124 are installed. Guide wires 124 may be thin metal wires spaced apart across the existing basement wall 120 or the first layer of sprayable concrete material 108 to maintain a substantially uniform application of the first layer of sprayable concrete material 108 or the second layer of sprayable concrete material 112.

Figure 2B:
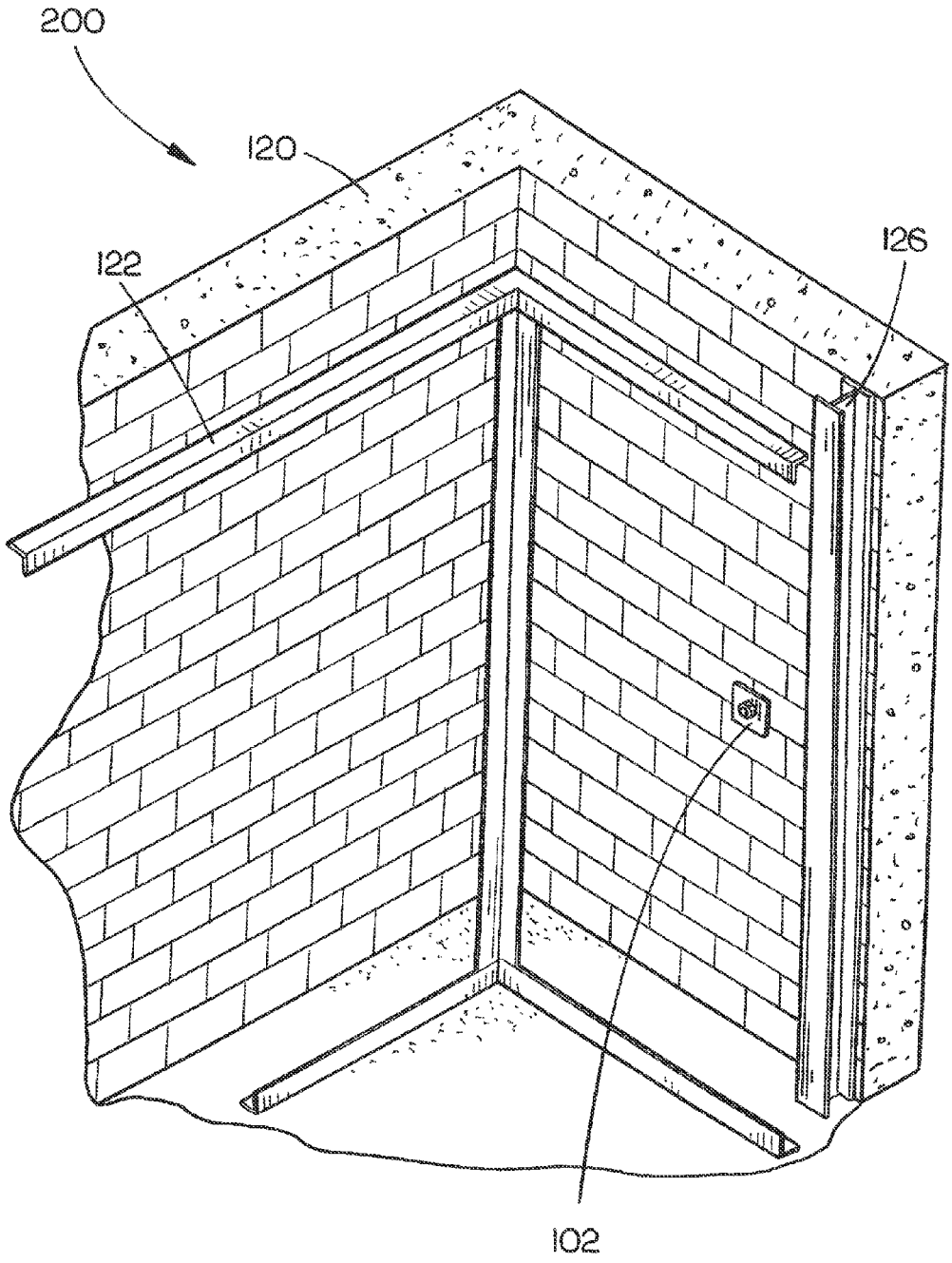
FIG. 2B is an exploded isometric view of an existing basement wall including a first anchoring plate according to an embodiment of the disclosure.
Figure 2C:
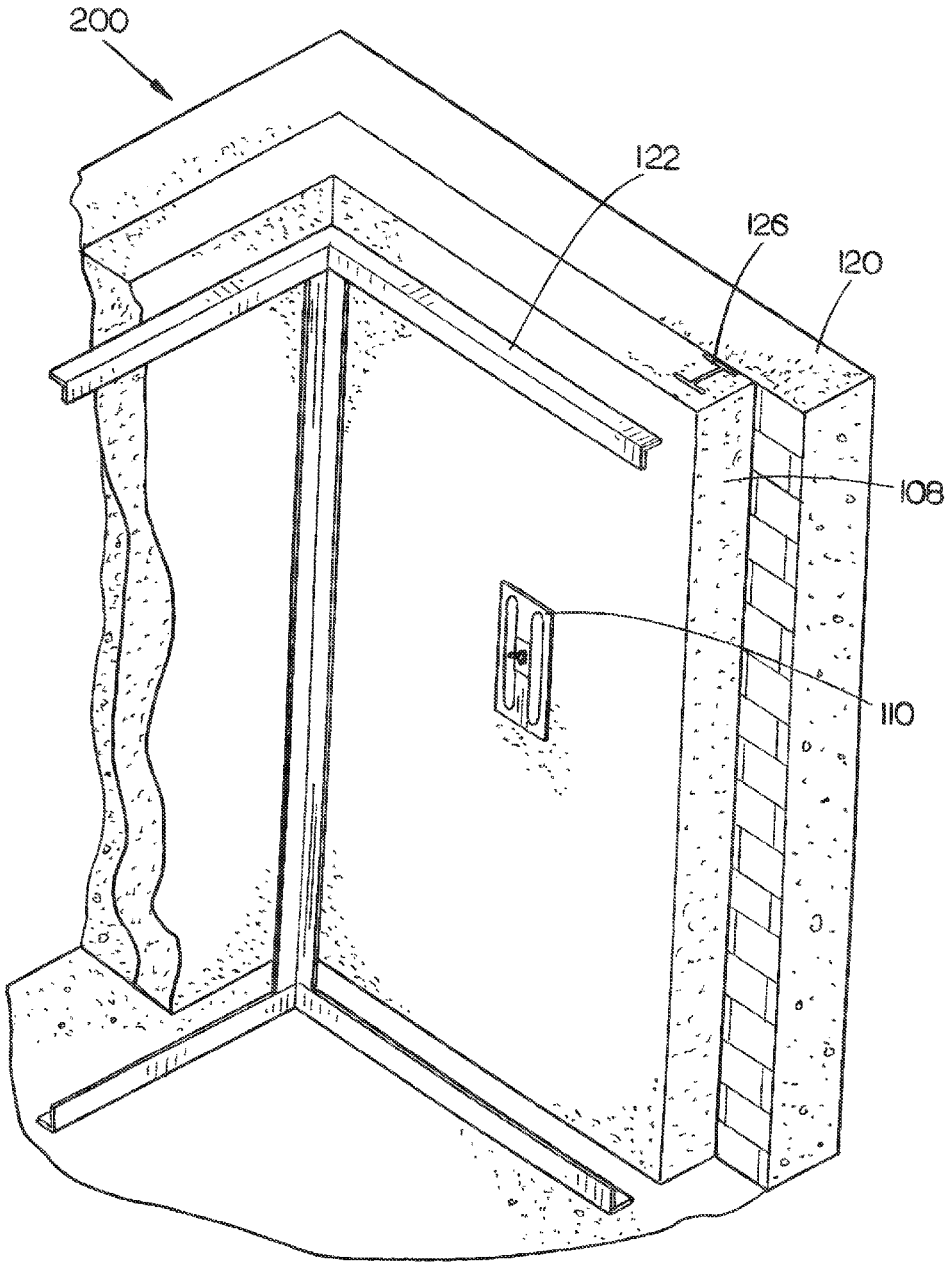
FIG. 2C is an exploded isometric view of an existing basement wall after application of a first layer of sprayable concrete material and installation of a third anchor plate according to an embodiment of the disclosure.
Figure 2D:
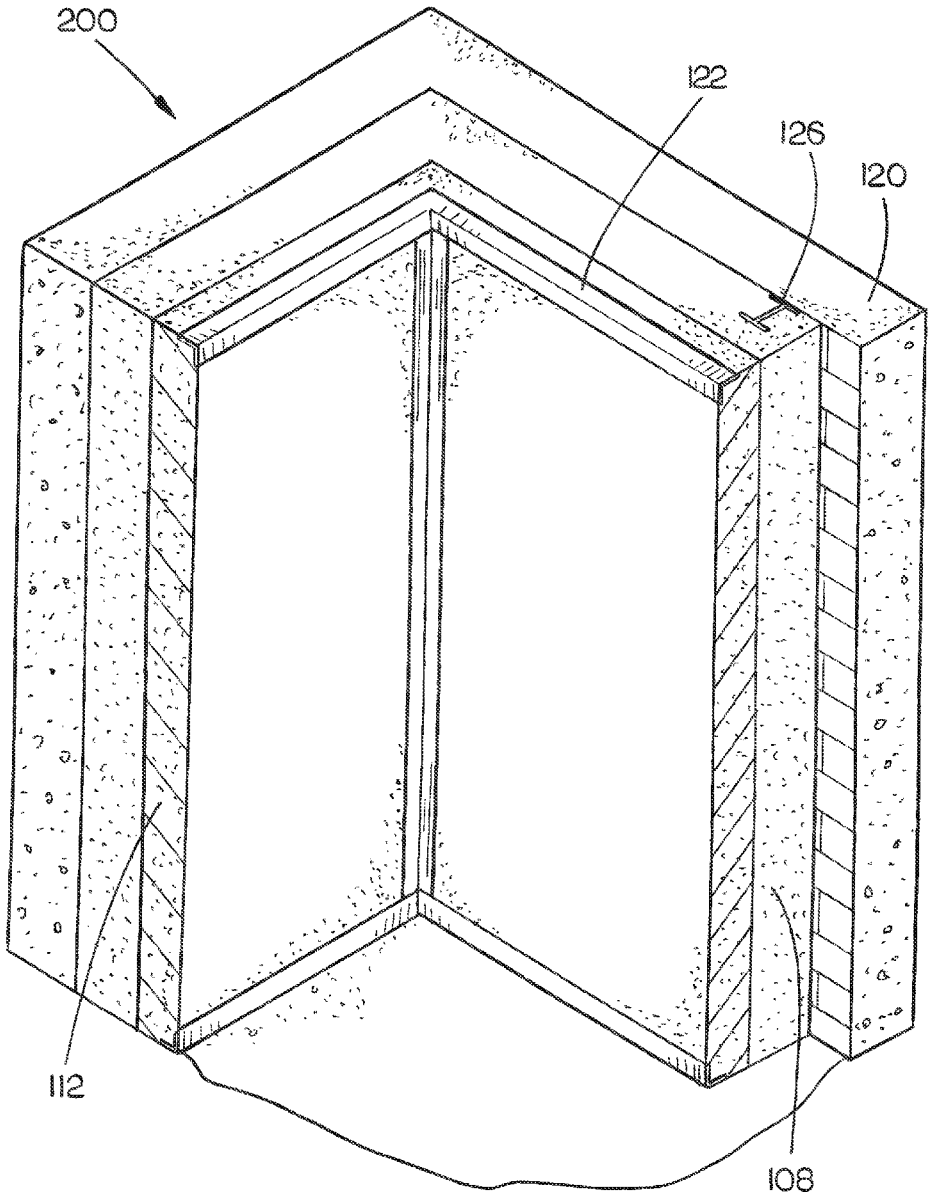
FIG. 2D is an exploded isometric view of an existing basement wall after application of a second layer of sprayable concrete material according to an embodiment of the disclosure.
Figure 3:
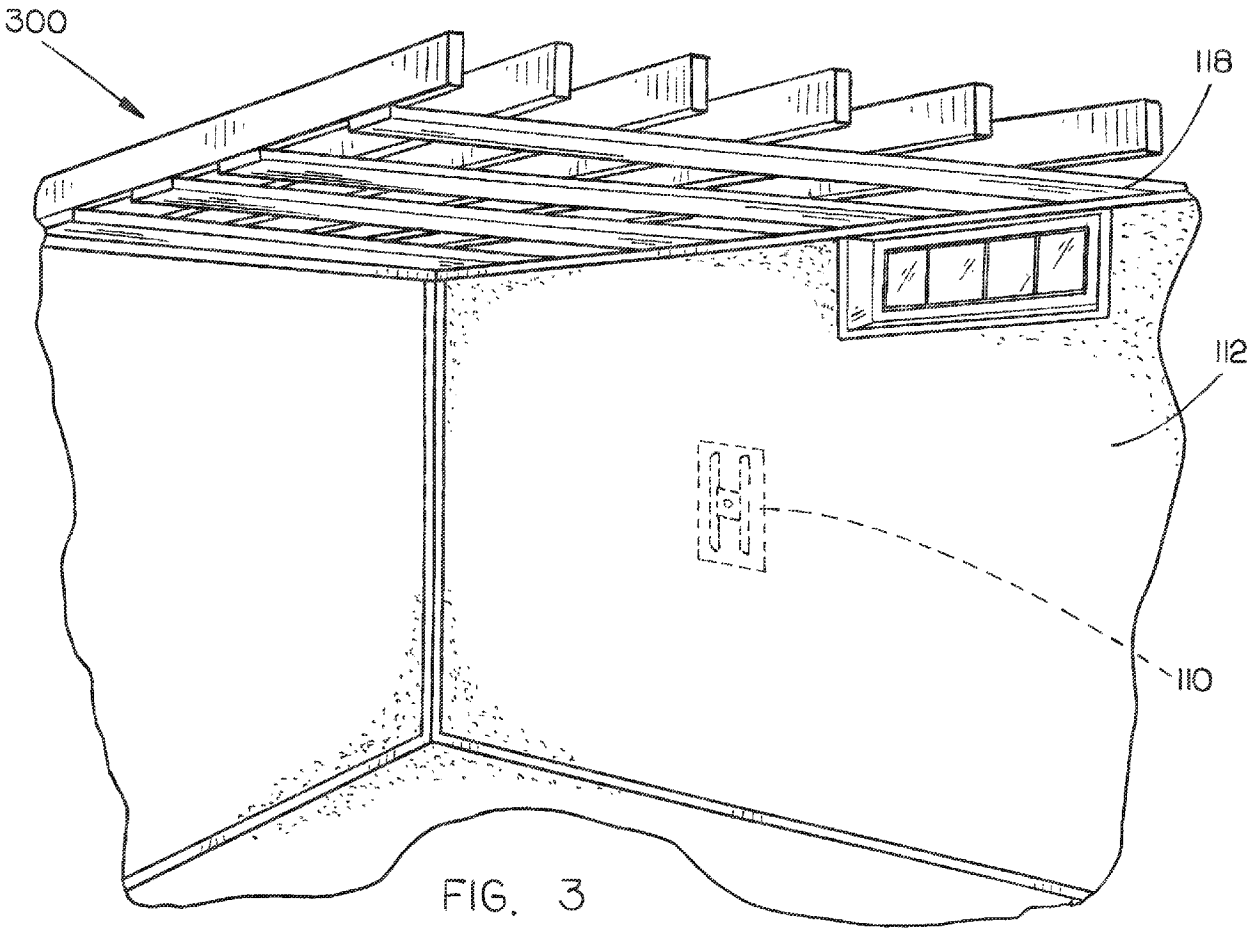
FIG. 3 is an isometric view of a finished basement wall according to an embodiment of the disclosure.
Figure 4:
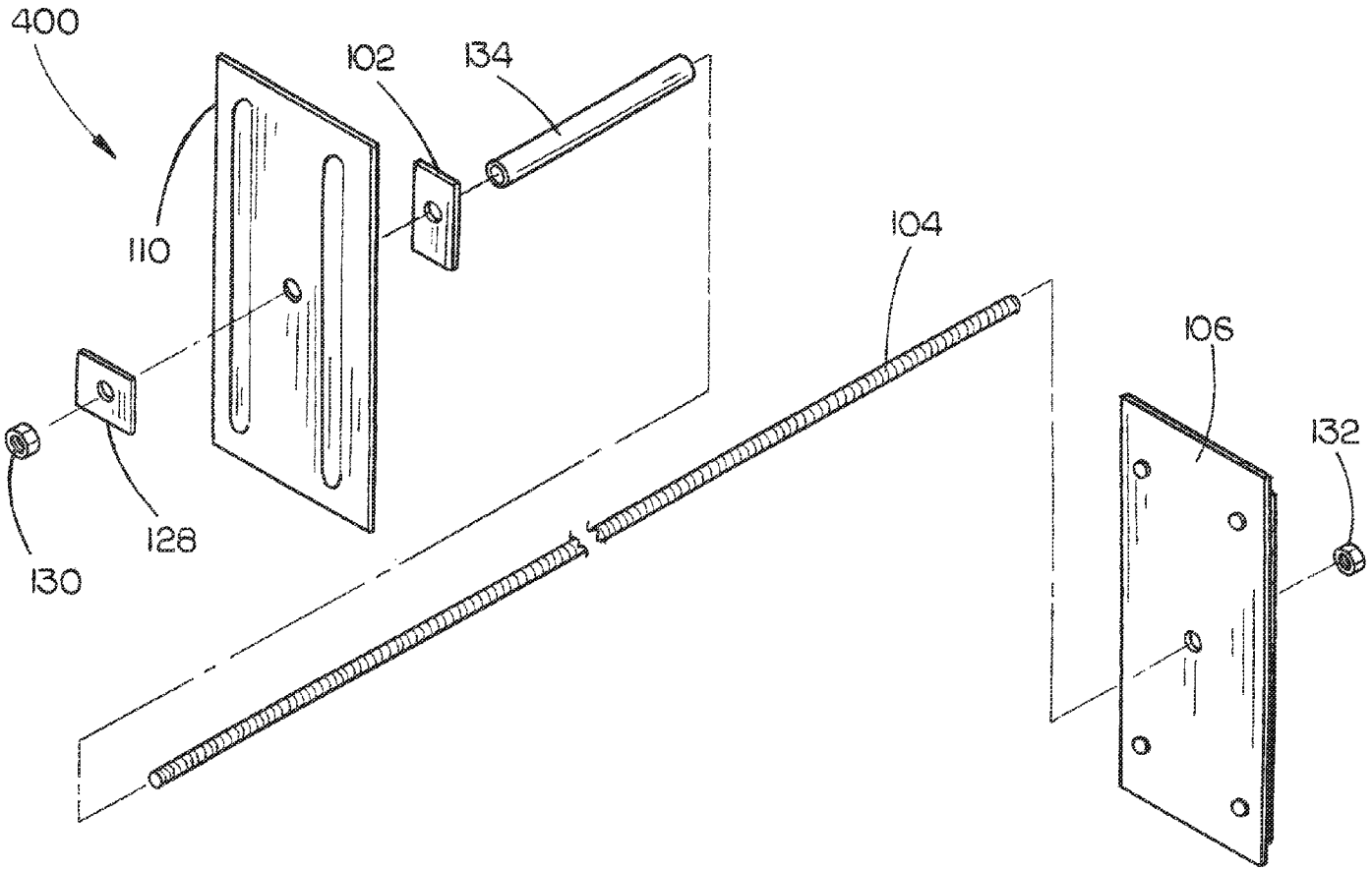
FIG. 4 is an isometric view of an wall anchoring assembly according to an embodiment of the disclosure.
Figure 5:
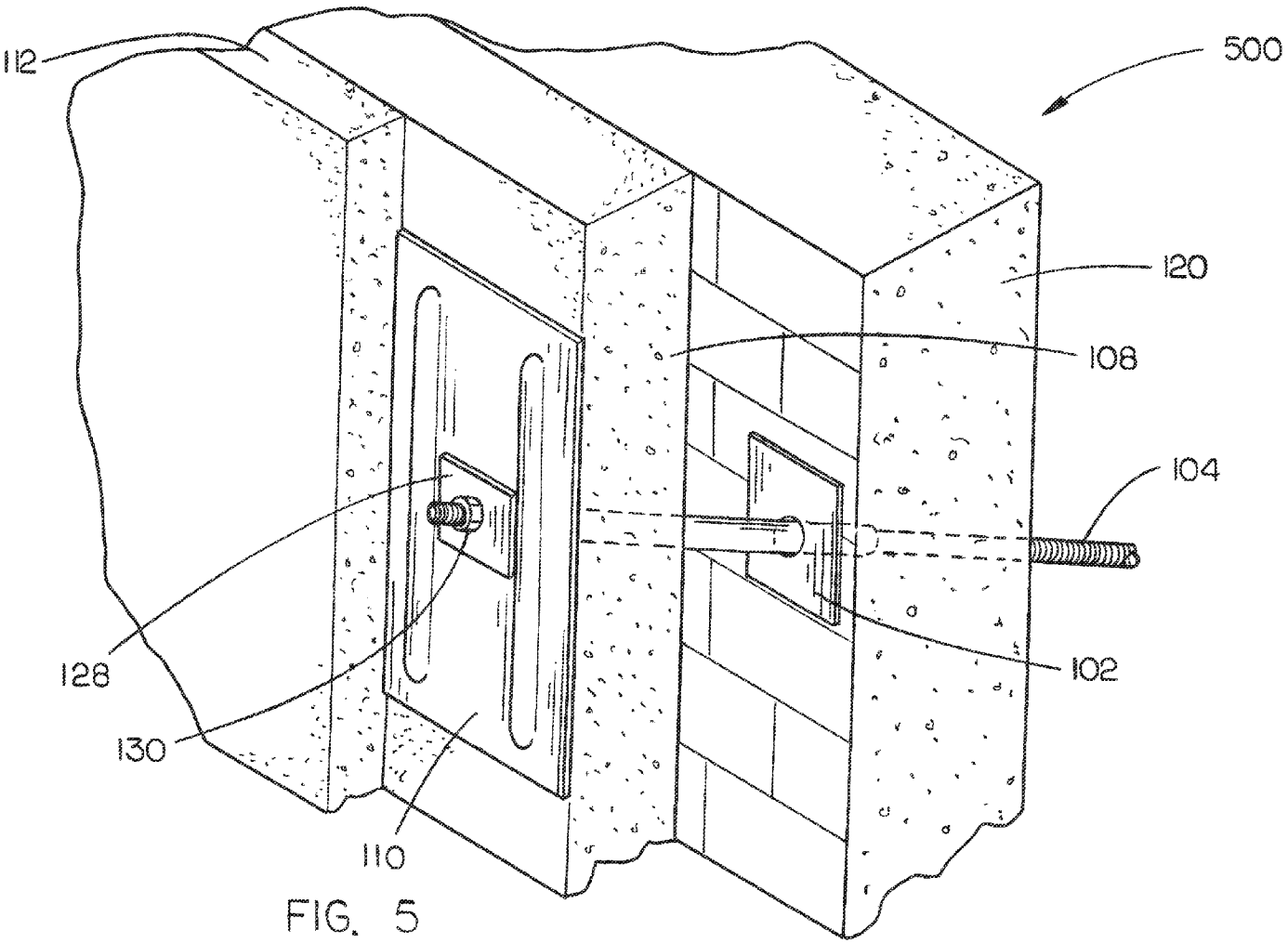
FIG. 5 is an exploded isometric view of an installed wall anchoring assembly according to an embodiment of the disclosure.

In an alternative embodiment, as shown in FIGS. 2A-2C, one or more reinforcement beams 126 may be installed vertically along at least one of the existing basement wall 120, the first layer of sprayable concrete material 108 or the second layer of sprayable concrete material 112. As with the wall anchoring plates 102, 110, the one or more reinforcement beams 126 may be substantially concealed by the first and/or second layer of sprayable concrete material 108, 112. Reinforcement beams 126 may be installed instead of or in addition to the one or more other wall stabilizing systems (e.g., the wall anchoring system described above). Reinforcement beams 126 may be composed of steel or any other heavy duty material suitable for providing reinforcement for the existing basement wall. Reinforcement beams 126 may be formed in any suitable shape or size. For instance, reinforcement beams may be C channel beams or I-beams. In a preferred embodiment, reinforcement beams may be PowerBrace™ type foundation wall reinforcement beams provided by Foundation Supportworks, Inc. of Omaha, Nebr. Reinforcement beams 126 may be positioned against the existing basement wall and held in place by wood framing that attaches to joists at the top of the existing basement wall and a bolt at the bottom of the wall that is driven into the floor. Alternatively, the floor may be opened and the beam attached to the footer. It is further contemplated that any wall stabilizing system may be utilized in conjunction with the sprayable concrete material to provide basement wall stabilization.

Figure 6:
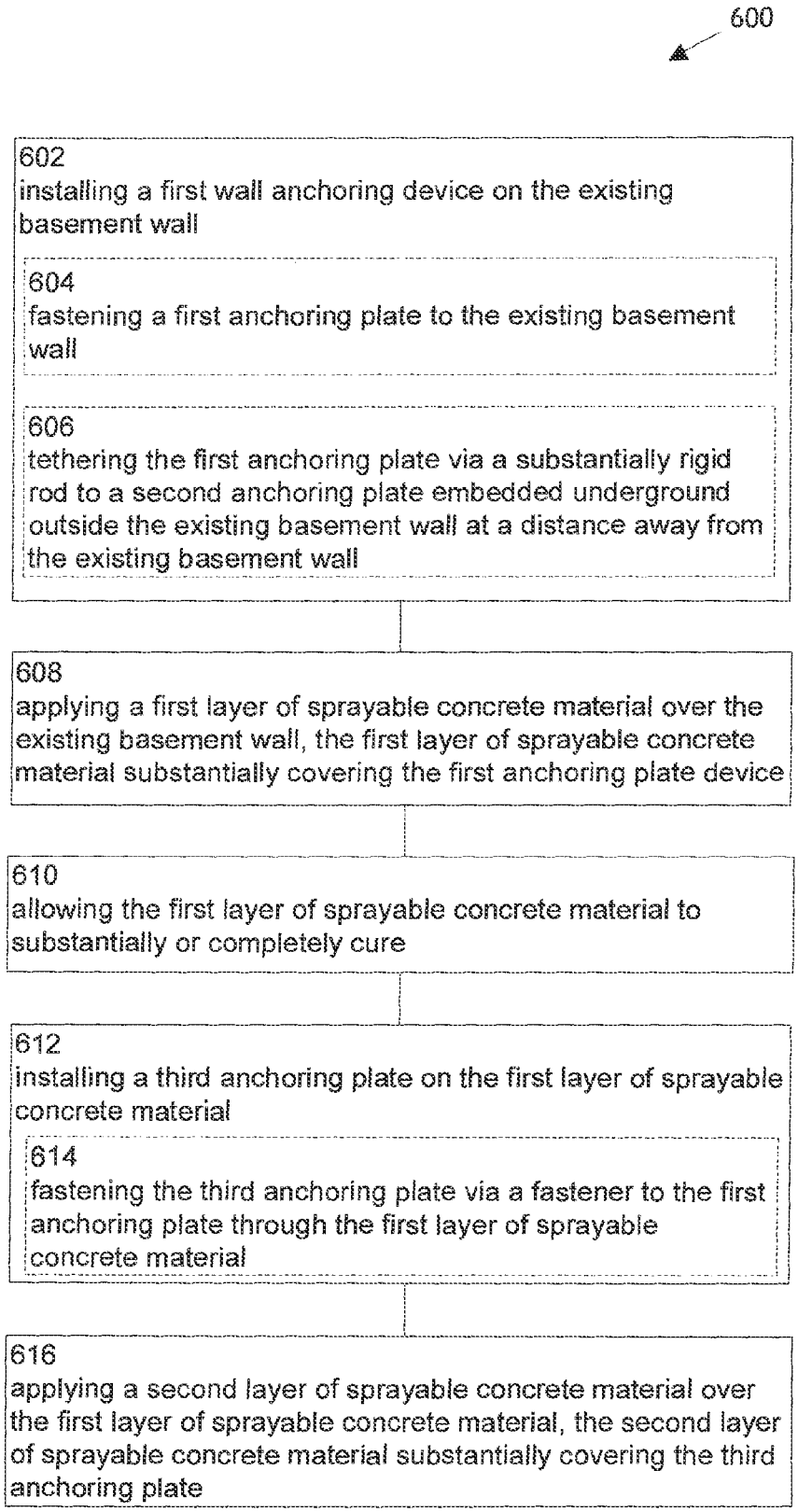
FIG. 6 is a is an operational flow illustrating a method for providing a foundation wall stabilizing system.
Figure 7:
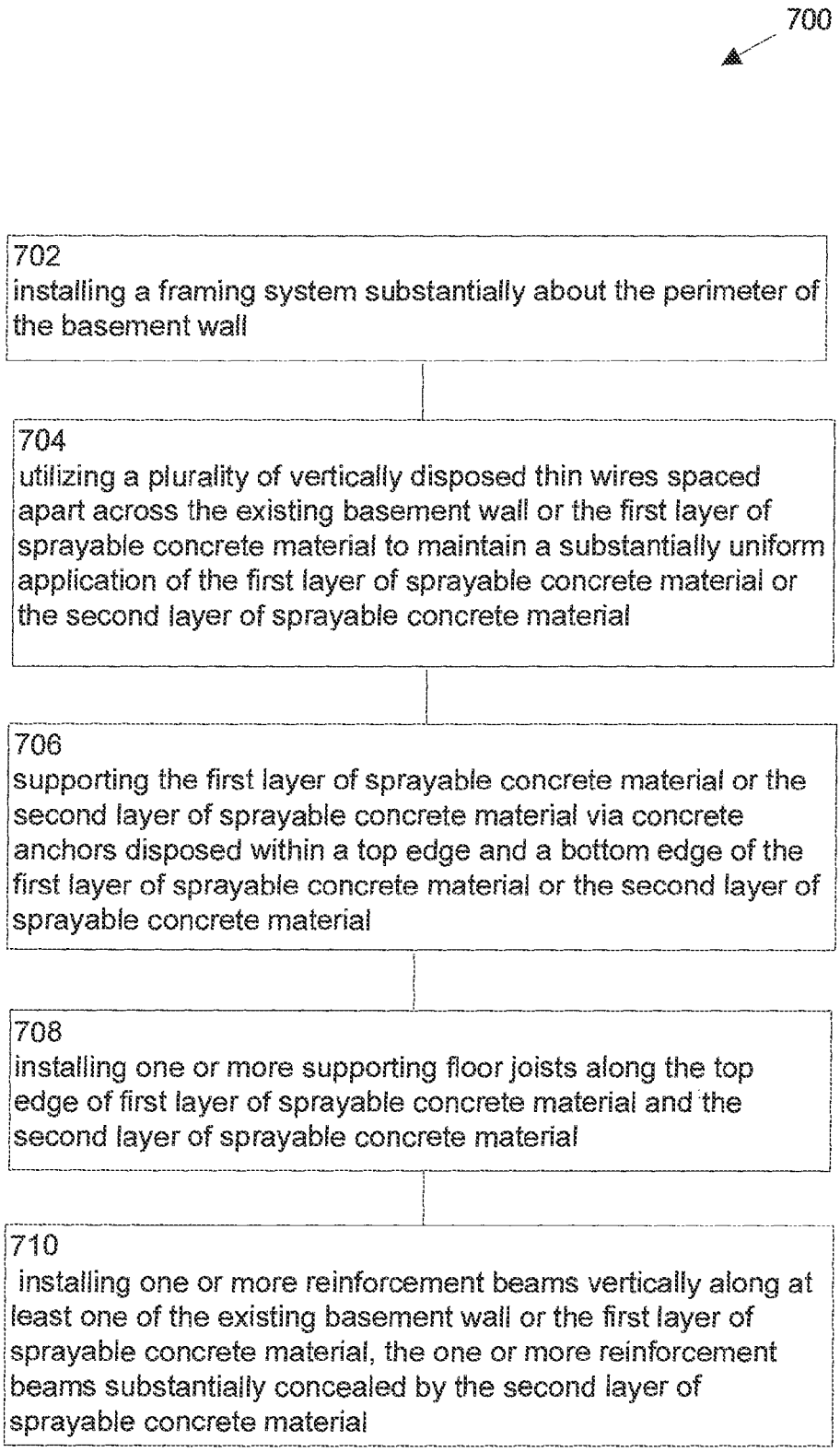
FIG. 7 is a is an operational flow illustrating a method for providing a foundation wall stabilizing system.

FIGS. 6-7 illustrate an operational flows representing a method 600 related to FIGS. 1-5. In FIG. 6 and in following figures that include various examples of operational flows, discussion and explanation may be provided with respect to the above-described examples of FIGS. 1-5 and/or with respect to other examples and contexts. However, it should be understood that the operational flows may be executed in a number of other environments and contexts, and/or in modified versions of FIGS. 1-5. Also, although the various operational flows are presented in the sequence(s) illustrated, it should be understood that the various operations may be performed in other orders than those which are illustrated, or may be performed concurrently.

In another instance of the disclosure illustrated in FIGS. 6-7, a method 600 for stabilizing an existing basement wall is contemplated. FIG. 6 further illustrates embodiments of the example operational flow 600 of FIG. 6. FIG. 6 illustrates example embodiments of the method 600 where the operation 602 may include at least one additional operation. Additional operations may include an operation 604, an operation 606, 608, 610, 612, 614 and/or an operation 616.

The operation 602 depicts installing a first wall anchoring device on the existing basement wall. Operation 602 may further include fastening a first anchoring plate to the existing basement wall 604 and tethering the first anchoring plate via a substantially rigid rod to a second anchoring plate embedded underground outside the existing basement wall at a distance away from the existing basement wall 606. The first anchoring plate may provide a first amount of support to the existing basement wall.

Method 600 may also include applying a first layer of sprayable concrete material over the existing basement wall, the first layer of sprayable concrete material substantially covering the first anchoring plate device 608. Method 600 may also include allowing the first layer of sprayable concrete material to substantially or completely cure 610. Method 600 may also include installing a third anchoring plate on the first layer of sprayable concrete material 612, further including fastening the third anchoring plate via a fastener to the first anchoring plate through the first layer of sprayable concrete material 614. Method 600 may also include applying a second layer of sprayable concrete material over the first layer of sprayable concrete material, the second layer of sprayable concrete material substantially covering the third anchoring plate 616. The first and second layers of sprayable concrete material may provide additional support and stabilization for the existing basement wall.

FIG. 7 illustrates an alternative embodiment 700 of the example operational flow 600. Additional operations may include an operation 702, operation 704, 706, 708 and/or an operation 710. Operation 702 depicts installing a framing system substantially about the perimeter of the basement wall. Operation 704 depicts utilizing a plurality of vertically disposed thin wires spaced apart across the existing basement wall or the first layer of sprayable concrete material to maintain a substantially uniform application of the first layer of sprayable concrete material or the second layer of sprayable concrete material.

Method 700 may also include supporting the first layer of sprayable concrete material or the second layer of sprayable concrete material via concrete anchors disposed within a top edge and a bottom edge of the first layer of sprayable concrete material or the second layer of sprayable concrete material 706. Method 600 may also include installing one or more supporting floor joists along the top edge of first layer of sprayable concrete material and the second layer of sprayable concrete material 708. Method 600 may also include installing one or more reinforcement beams vertically along at least one of the existing basement wall or the first layer of sprayable concrete material, the one or more reinforcement beams substantially concealed by the second layer of sprayable concrete material 710.

The herein described subject matter sometimes illustrates different components contained within, or connected with, different other components. It is to be understood that such depicted architectures are merely exemplary, and that in fact many other configurations may be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected", or "operably coupled", to each other to achieve the desired functionality, and any two components capable of being so associated can also be viewed as being "operably couplable", to each other to achieve the desired functionality. Specific examples of operably couplable include but are not limited to physically mateable and/or physically interacting components.

It is to be understood that the invention is defined by the appended claims. It will be understood by those within the art that, in general, terms used herein, and especially in the appended claims (e.g., bodies of the appended claims) are generally intended as "open" terms (e.g., the term "including"

should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number.

While particular aspects of the present subject matter described herein have been shown and described, it will be apparent to those skilled in the art that, based upon the teachings herein, changes and modifications may be made without departing from the subject matter described herein and its broader aspects and, therefore, the appended claims are to encompass within their scope all such changes and modifications as are within the true spirit and scope of this subject matter described herein.

The invention claimed is:

1. A system for stabilizing an existing basement wall comprising:

a wall stabilizing system including a first wall anchoring device installed on a surface of the existing basement wall, the first wall anchoring device further including a first anchoring plate fastened to a surface of the existing basement wall tethered via a substantially rigid rod to a second anchoring plate embedded underground outside the existing basement wall at a distance away from the existing basement wall;

a first layer of sprayable concrete material applied over the existing basement wall;

a third anchoring plate installed on a surface of the first layer of sprayable concrete material, the third anchoring plate attached to the first anchoring plate by the rigid rod which passes through the first layer of sprayable concrete material and one or more fasteners for fastening the third anchoring plate to a surface of the first layer of sprayable concrete material; and a second layer of sprayable concrete material applied over the first layer of sprayable concrete material.

2. The system of claim 1, further including a framing system installed substantially about the perimeter of the basement wall.

3. The system of claim 1, wherein the first layer of sprayable concrete material is between about 1 to 5 inches in thickness.

4. The system of claim 1, wherein the second layer of sprayable concrete material is between about 1 to 5 inches in thickness.

5. The system of claim 1, wherein a total thickness of the first layer of sprayable concrete material and the second layer of sprayable concrete material is between about 5 to 10 inches.

6. The system of claim 1, further including a plurality of vertically disposed thin wires spaced apart across the existing basement wall or the first layer of sprayable concrete material to maintain a substantially uniform application of the first layer of sprayable concrete material or the second layer of sprayable concrete material.

7. The system of claim 1, wherein the first anchoring plate has an area less than the area of the third anchoring plate.

8. The system of claim 1, further including a plurality of concrete anchors disposed within a top edge and a bottom edge of the first layer of sprayable concrete material or the second layer of sprayable concrete material supporting the first layer of sprayable concrete material or the second layer of sprayable concrete material.

9. The system of claim 1, further including one or more supporting floor joists installed along the top edge of first layer of sprayable concrete material and the second layer of sprayable concrete material.

10. The system of claim 1, further including one or more reinforcement beams installed vertically along at least one of the existing basement wall or the first layer of sprayable concrete material, the one or more reinforcement beams substantially concealed by the second layer of sprayable concrete material.

11. A method for stabilizing an existing basement wall comprising:

installing a first wall anchoring device on the existing basement wall further including fastening a first anchoring plate to the existing basement wall and tethering the first anchoring plate via a substantially rigid rod to a second anchoring plate embedded underground outside the existing basement wall at a distance away from the existing basement wall, the first anchoring plate may provide a first amount of support to the existing basement wall;

applying a first layer of sprayable concrete material over the existing basement wall, the first layer of sprayable concrete material substantially covering the first anchoring plate device;

allowing the first layer of sprayable concrete material to substantially or completely cure;

installing a third anchoring plate on the first layer of sprayable concrete material, further including fastening a third anchoring plate via a fastener to the first anchoring plate through the first layer of sprayable concrete material; and applying a second layer of sprayable concrete material over the first layer of sprayable concrete material, the second layer of sprayable concrete material substantially covering the third anchoring plate.

12. The method of claim 11, further including installing a framing system substantially about the perimeter of the basement wall.

13. The method of claim 11, wherein the first layer of sprayable concrete material is between about 1 to 5 inches in thickness.

14. The method of claim 11, wherein the second layer of sprayable concrete material is between about 1 to 5 inches in thickness.

15. The method of claim 11, wherein a total thickness of the first layer of sprayable concrete material and the second layer of sprayable concrete material is between about 5 to 10 inches.

16. The method of claim 11, further including utilizing a plurality of vertically disposed thin wires spaced apart across the existing basement wall or the first layer of sprayable concrete material to maintain a substantially uniform application of the first layer of sprayable concrete material or the second layer of sprayable concrete material.

17. The method of claim 11, wherein the first anchoring plate has an area less than the area of the third anchoring plate.

18. The method of claim 11, further including supporting the first layer of sprayable concrete material or the second layer of sprayable concrete material via concrete anchors disposed within a top edge and a bottom edge of the first layer of sprayable concrete material or the second layer of sprayable concrete material.

19. The method of claim 11, further including installing one or more supporting floor joists along the top edge of first layer of sprayable concrete material and the second layer of sprayable concrete material.

20. The method of claim 11, further including installing one or more reinforcement beams vertically along at least one of the existing basement wall or the first layer of sprayable concrete material, the one or more reinforcement beams substantially concealed by the second layer of sprayable concrete material.

* * * * *